US006067689A

United States Patent [19]

Roney et al.

[11] Patent Number: 6,067,689

[45] Date of Patent: May 30, 2000

[54] SHIFTER MECHANISM FOR VACUUM CLEANER

[75] Inventors: Jeffrey T. Roney, Stanford; Eric V. Fosbrink, Lancaster, both of Ky.

[73] Assignee: Matsushita Electric Corporation of America, Danville, Ky.

[21] Appl. No.: 09/125,967

[22] PCT Filed: Dec. 31, 1996

[86] PCT No.: PCT/US96/20907

§ 371 Date: Aug. 27, 1998

§ 102(e) Date: Aug. 27, 1998

[87] PCT Pub. No.: WO98/29021

PCT Pub. Date: Jul. 9, 1998

[51] Int. Cl.[7] ..... A47L 9/00

[52] U.S. Cl. ..... 15/390; 15/332

[58] Field of Search ..... 15/332, 390, 389

[56] References Cited

U.S. PATENT DOCUMENTS

| | | | |
|---|---|---|---|
| 4,068,341 | 1/1978 | Scott et al. | 15/390 X |
| 4,446,595 | 5/1984 | Nakada et al. . | |
| 4,637,092 | 1/1987 | Hayashi et al. . | |
| 4,748,714 | 6/1988 | Tschudy . | |
| 5,331,716 | 7/1994 | Hemmann et al. . | |
| 5,839,160 | 11/1998 | Wang et al. | 15/390 |

FOREIGN PATENT DOCUMENTS

| | | |
|---|---|---|
| 57-39540 | 3/1982 | Japan . |
| 57-131420 | 8/1982 | Japan . |

*Primary Examiner*—Chris K. Moore
*Attorney, Agent, or Firm*—King and Schickli, PLLC

[57] ABSTRACT

A vacuum cleaner (10) includes a housing (14), an agitator brush (40) mounted for relative rotation in the housing (14) and a motor (30) including a shaft (42) for driving the agitator brush (40). A flexible belt (44) connects the drive shaft (42) of the motor (30) to the agitator brush (40). Further, a mechanism (50) is provided for disconnecting the belt (44) from either the motor drive shaft (42) or the agitator brush (40). That mechanism (50) includes an element or lug (54) carried on a shifter (52) and an actuator (56) for selectively displacing the shifter (52) and element/lug (54) carried thereon between a first position wherein the element/lug (54) is out of engagement with said belt (44) and a second position wherein the element/lug (54) engages the belt (44), thereby forcing the belt (44) out of engagement with either the motor drive shaft (42) or the agitator brush (40).

10 Claims, 3 Drawing Sheets

SHIFTER MECHANISM FOR VACUUM CLEANER

TECHNICAL FIELD

The present invention relates generally to the field of vacuum cleaning devices and more particularly to an upright vacuum cleaner incorporating a mechanical shift system that disengages the drive between the motor and agitator brush in order to enhance overall bare floor cleaning efficiency.

BACKGROUND OF THE INVENTION

In order to enhance cleaning efficiency it is well known to equip a vacuum cleaner with a driven agitator brush that is rotated to beat or brush dirt and debris from the nap of the carpet being cleaned so that the dirt and debris may then be drawn by the vacuum suction into the vacuum cleaner bag for disposal. While a driven agitator brush is very effective for this purpose, it has been found to hinder the cleaning action of a vacuum cleaner when used on bare floors. Specifically, the rotating brush generates a flow of air that tends to push dust, hair balls and other lightweight debris away from the vacuum nozzle and the vacuum suction that would otherwise draw this material into the dust bag. As a result, the cleaning efficiency of the vacuum suffers and the vacuum operator may become flustered and aggravated with the operation of the vacuum-cleaner.

In order to address this shortcoming, many vacuum cleaners now incorporate a shifter mechanism including several carpet and bare floor settings. When the shifter mechanism is positioned on a carpet setting, the agitator brush is engaged and rotated. Conversely, when the shifter mechanism is engaged on the bare floor setting, the drive to the agitator brush is interrupted. Since the agitator brush is not rotating, it generates no air flow and consequently, lightweight debris such as dust and hair balls on the bare floor are not pushed away from the nozzle assembly of the vacuum cleaner. Instead, they are drawn by suction force directly into the vacuum cleaner and eventually the vacuum cleaner bag. In this way, bare floor cleaning efficiency is enhanced.

In order to provide this operation, a number of expensive and complicated mechanical operating designs have been devised. In one such approach, the vacuum cleaner is equipped with two separate motors. One motor functions to drive the agitator brush while the other motor functions to drive the fan for generating the vacuum suction. In this approach, when a shifter mechanism is set to provide for bare floor operation, the motor that drives the agitator brush is deenergized and the brush rotation stops while the motor that drives the fan continues to operate at full speed generating vacuum suction. In an alternative approach, a single motor is provided with a clutch system between the motor and the belt and pulley system that drives the agitator brush. Thus, when the shifter mechanism is engaged on the bare floor setting, the clutch system operates to disengage the motor and the agitator brush so that the brush is not driven.

In still another alternative approach, a two belt system is provided. The two belt system includes one belt connected between the motor drive shaft and a first, constantly driven idler pulley and a second belt connected between the agitator brush and a second idler pulley. When the shifter mechanism is engaged in the bare floor setting, the second idler pulley is operatively disconnected from the first idler pulley and, therefore, neither the second idler pulley nor the agitator brush is driven.

While all of these prior art approaches effectively allow the agitator brush to be disengaged for vacuum cleaning, it should be appreciated that all these designs suffer from a number of drawbacks that prevent any one of them from being an ideal solution to the problem. The two motor system is, of course, relatively expensive to produce. Further, the second motor adds weight to the vacuum cleaner and many users find this added weight to be a discomfort and an inconvenience when manipulating the vacuum cleaner across the floor or carrying it from room to room.

A vacuum cleaner clutch system of the type described is relatively difficult and expensive to manufacture. It significantly increases the cost of the vacuum cleaner and while generally reliable it is an additional mechanical system that from time to time may be the subject of mechanical failure.

Similarly, the two belt system relies upon the utilization of two belts instead of one. It is well known that belts stretch and wear over time and require periodic replacement. Many vacuum cleaner users find belt replacement to be an inconvenient nuisance and the provision of two belts instead of one only adds to this perceived problem.

Perhaps the best solution to this problem to date is disclosed in published Japanese patent application no 57-131420. In this design, a belt driven agitator brush and a displaceable idler roller are provided. When in a first position, the idler roller does not interface with the belt drive. When in a second position, the idles roller disengages the belt from the motor drive shaft thereby allowing the shaft to turn freely and the agitator roller to come to a stop. While this is a more cost effective design than the approaches described above, it still suffers, from some shortcomings. For example, the throw of the shift lever to move between the two operating positions is almost 180°. This is uncomfortable and inconvenient to manipulate.

Accordingly, it should be appreciated that all prior art approaches suffer a number of distinct disadvantages and drawbacks. A need is therefore identified for a new solution to the problem. Ideally, the new solution will allow one to disengage the drive system from the agitator brush when vacuuming bare floors in a user friendly manner and in a cost effective manner without adversely affecting the operating characteristics of the vacuum cleaner or inconveniencing the user in any manner.

SUMMARY OF THE INVENTION

Accordingly, it is a primary object of the present invention to provide a vacuum cleaner allowing an agitator brush to be selectively disengaged from the drive motor while overcoming the limitations and disadvantages of the prior art.

Another object of the present invention is to provide a vacuum cleaner incorporating a carpet/bare floor shifter mechanism of relatively simple design and inexpensive construction that advantageously allows the user to disengage the agitator brush from the drive motor so as to allow more efficient bare floor vacuum cleaning.

Still another object of the present invention is to provide a vacuum cleaner with a carpet/bare floor shifter mechanism that effectively operates in a user friendly manner to engage or disengage the agitator brush and drive motor by the simple manipulation of a foot pedal actuator through a relatively short throw.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved vacuum cleaner is provided. The vacuum cleaner includes a housing and an agitator brush mounted for relative rotation on the housing. A motor is also held in the housing and includes a shaft for driving the agitator brush. A flexible belt connects the motor drive shaft with the agitator brush. In addition, a lug is provided for operatively disconnecting the belt from either the motor shaft or the agitator brush when the user desires such when vacuuming a bare floor.

More specifically, the lug for disconnecting the belt is carried on a shifter. Additionally, an actuator is provided for selectively displacing the shifter between a first position wherein the lug is out of engagement with the belt and a second position wherein the lug engages the belt, thereby forcing the belt out of engagement with either the motor shaft or the agitator brush. Accordingly, in the second position, the drive between the motor and agitator brush is interrupted. As a result, the agitator brush ceases to rotate and, accordingly, the only air movement in the nozzle area of the vacuum cleaner is the vacuum suction generated by the motor. This suction serves to draw debris into the vacuum cleaner bag where it is efficiently collected for disposal.

Preferably, in the first position, the lug is positioned between the agitator brush and the motor shaft in a pathway defined by the belt. In the second position, the lug is positioned to one side of both the agitator brush and the motor shaft functioning to disconnect the belt from either the brush or shaft thereby interrupting the drive system.

Preferably, the shifter and agitator include meshing teeth and are designed to provide an almost two to one ratio whereby movement of the actuator through an arc of A° serves to move the shifter and lug held thereon through an arc of approximately 2 A°. More specifically, the actuator includes a tooth rack having a length L and the shifter includes gear teeth having a circumference 2L. The actuator also includes an opening providing the necessary clearance to receive the gear teeth of the shifter. The tooth rack partially defines the outline of the opening. Accordingly, the actuator tooth rack and the shifter gear teeth are provided in meshing relationship. Further, the actuator is provided with a foot pedal so as to allow easy and convenient manipulation and shifting between a carpet position wherein the drive system is engaged and the agitator brush is rotated at and a bare floor position wherein the drive system is disengaged or interrupted and the agitator brush is not driven.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
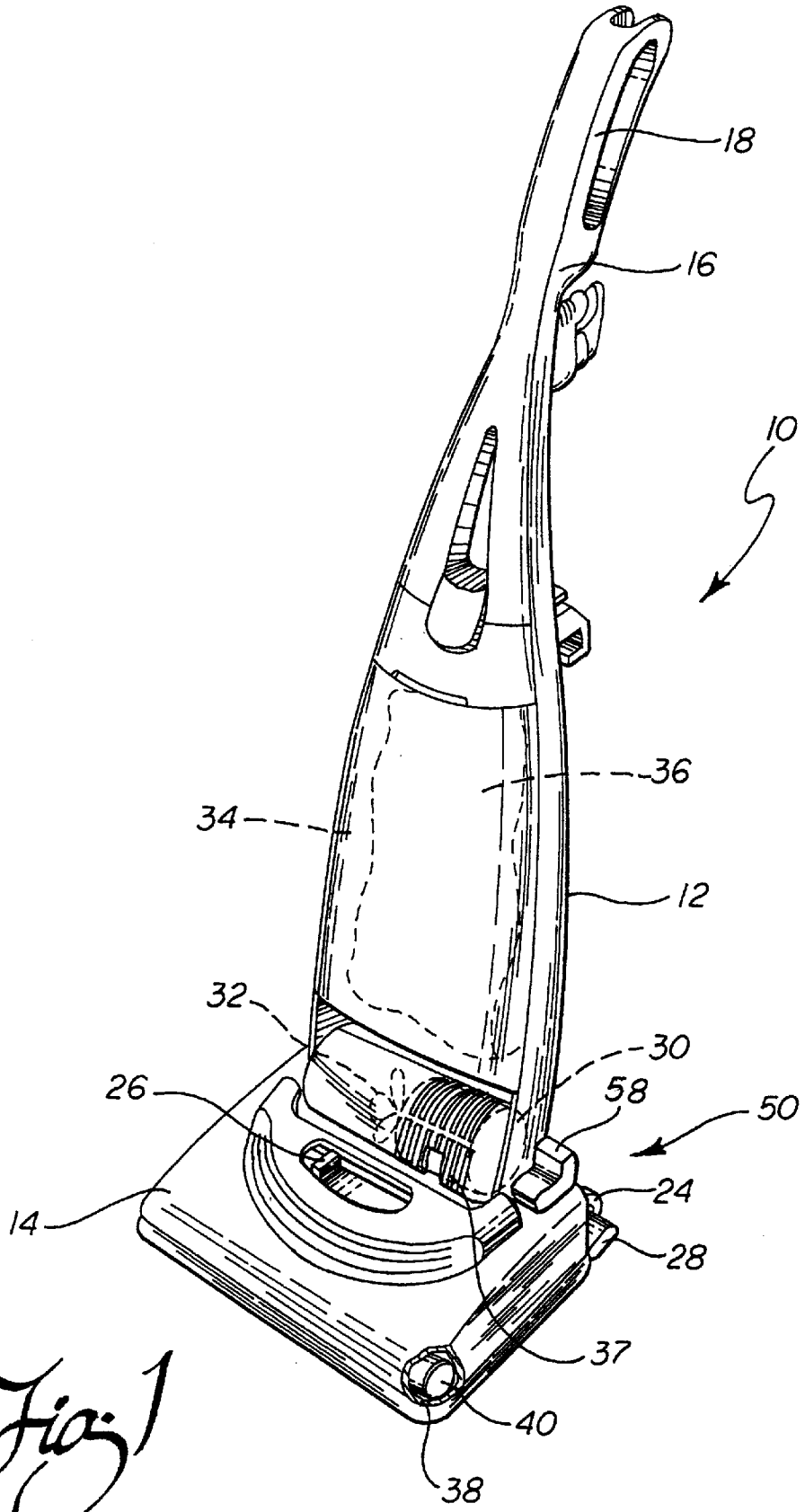
FIG. 1 is perspective view of a vacuum cleaner constructed in accordance with the teachings of the present invention.

Reference is now made to FIG. 1 showing in perspective view, an upright vacuum cleaner 10 constructed in accordance with the teachings of the present invention. The overall basic design of an upright vacuum cleaner 10 is generally well known in the art. Specifically, the upright vacuum cleaner 10 includes a canister assembly 12 pivotally connected to a nozzle assembly 14 by means of a hinge assembly. A handle 16 is rigidly attached to the top of the canister assembly 12. The handle 16 includes a hand grip 18 and power switch (not shown) for turning the vacuum cleaner on and off. Of course, electrical power is supplied through a cord also not shown.

At the lower portion of the canister assembly 12, rear wheels 24 are provided to support the weight of the vacuum cleaner 10 and provide a pivot point about which the nozzle assembly 14 pivots when the height of the nozzle assembly is adjusted by manipulation of the height adjustment switch 26. The operation of the height adjustment switch 26 and its cooperating mechanism are described in detail in U.S. Pat. No. 5,467,502 to Johnson et al. Of course, as is known in the art, a foot latch 28 locks the canister assembly 12 in an upright position shown in FIG. 1 in order to allow storage and off the floor cleaning. When the foot latch 28 is released, the canister assembly 12 may be pivoted relative to the nozzle assembly 14 in a manner well known in the art.

The canister assembly 12 also includes a motor 30 that drives a fan 32 which generates a negative pressure or vacuum suction in an internal chamber 34 which also houses a dust bag 36. Specifically, the motor 30 and fan 32 cooperate to draw dirt laden air into the chamber 34 and thorough the porous walls of the dust bag 36. The bag 36, of course, serves to trap suspended dirt and particles inside while allowing the air to pass freely through the exhaust port 37.

Nozzle assembly 14 includes, at its front portion, a nozzle 38 that houses a rotating agitator brush 40. The agitator brush 40 is rotatively driven by the motor 30. Specifically, the motor 30 includes a drive shaft 42 that is connected to the agitator brush 40 by means of a belt 44 (see also FIGS. 2 and 3). In order to maintain the belt 44 at the proper tension to drive the agitator brush 40 at substantially any till angle of the canister assembly 12/handle 16 relative to the nozzle assembly 14, the motor drive shaft 42 is concentrically disposed within a sleeve hinge 46 that provides the pivotal connection between the canister assembly 12 and nozzle assembly 14 at one side of the vacuum cleaner 10.

As it is rotated, the agitator brush 40 functions to loosen trapped dirt and particulate matter in a carpeted floor surface. The negative pressure or vacuum suction created by the motor 30 and fan 32 draw the air laden with this dirt and particulate matter from the nozzle 38 through the nozzle assembly 14 and the hose (not shown) into the chamber 34 in the canister assembly 12. There, the dirt and particulate matter is trapped in the dust bag 36 in the manner described above and well known in the art.

When attempting to clean bare floors, it has been found that a rotating agitator brush 40 often reduces cleaning efficiency. More specifically, the rotating agitator brush 40 generates air currents that tend to push lightweight debris such as dust and hair balls away from the nozzle assembly 14 so that they are not drawn through the nozzle 38 and hose into the dust bag 36. This is a particularly annoying problem for the vacuum cleaner user that must effectively "chase" dust and hair balls across the floor.

In order to address this problem, the vacuum cleaner 10 of the present invention incorporates a novel carpet/bare floor shifter mechanism generally designated by reference numeral 50. This mechanism may be utilized to operatively disconnect the belt 44 from either the motor drive shaft 42 or the agitator brush 40 in order to interrupt the drive system to the agitator brush. Accordingly, the motor 30 may continue to operate and drive the fan 32 thereby producing full vacuum suction while the agitator brush 40 is disengaged and stops. As a result, the vacuum cleaner may be utilized to more efficiently and effectively clean bare floor surfaces.

The carpet/bare floor shifter mechanism 50 includes a shifter 52 that carries a projecting lug 54 and a cooperating actuator 56 that includes a foot pedal 58. As should be appreciated, the actuator 56 is pivotally mounted by means of a pin 60 to nozzle assembly 14. The actuator 56 also includes a central opening 62 and carries an upwardly directed tooth rack 64. This tooth rack 64 engages and meshes with teeth 66 carried by the shifter 52 which extend through the opening 62. Shifter 52 is received for relative rotation about the sleeve hinge 46 and is therefore, co-axial with the motor drive shaft 42.

Figures 2, 3:
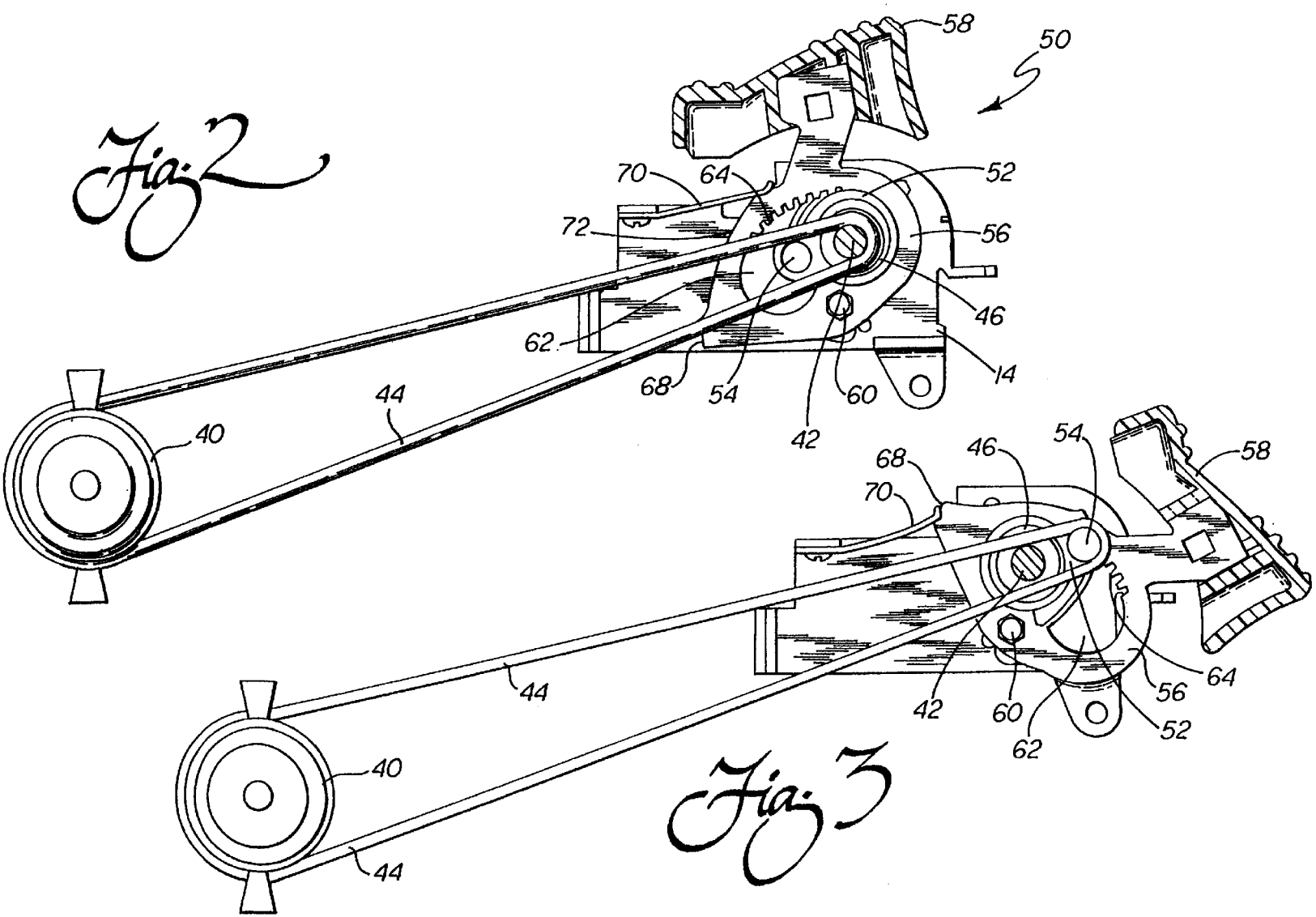
FIG. 2 is a schematical side elevational illustration of the carpet/bare floor shifter mechanism utilized to operatively disconnect the belt from either the drive shaft motor or the agitator brush shown in the first carpet cleaning position wherein the motor shaft and brush are engaged.
FIG. 3 is a schematical representation similar to FIG. 2 but showing the carpet/bare floor shifter mechanism in a second, bare floor cleaning position wherein the motor drive shaft and agitator brush are disengaged.
Figure 4:
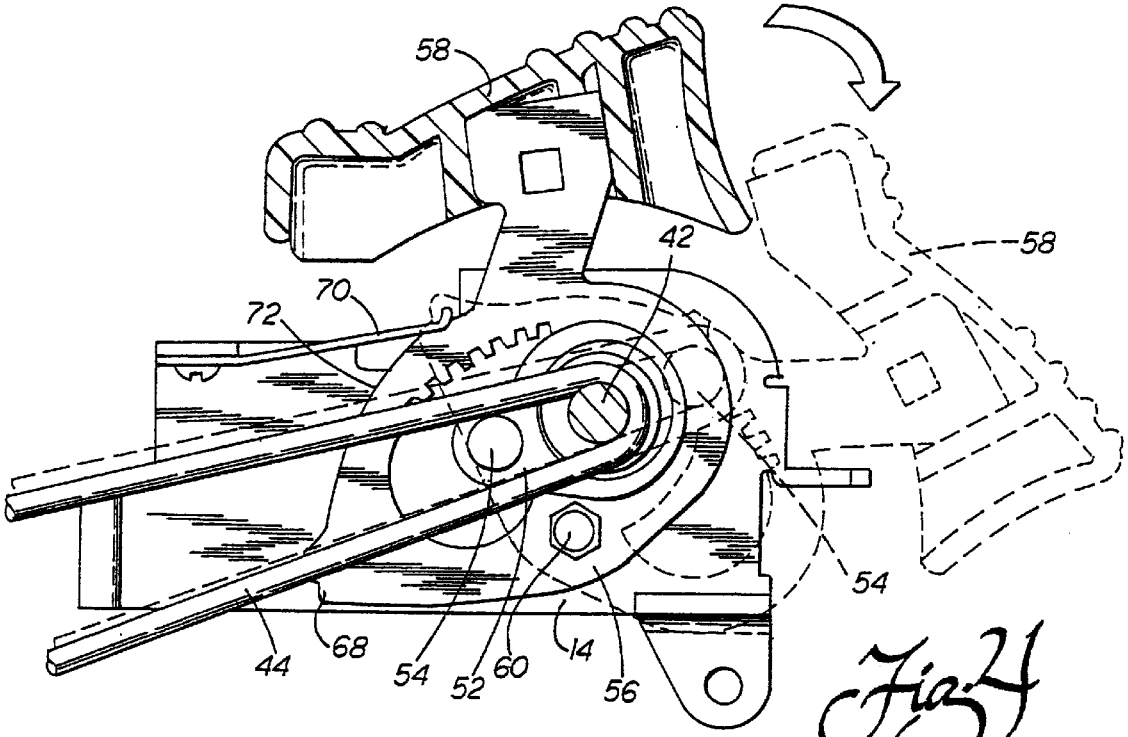
FIG. 4 is a detailed elevational view of the carpet/bare floor shifter mechanism further detailing its operation.
Figure 5:
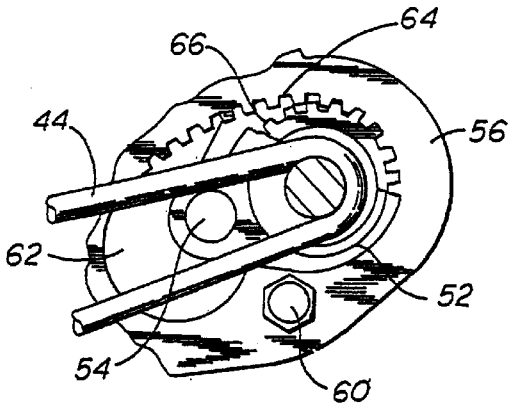
FIG. 5 is a reverse partially sectional view showing the meshing of the teeth on the shifter with the tooth rack on the actuator.

As should be appreciated from reviewing FIGS. 2–4 in combination, the actuator 56 and shifter 52 function through the tooth rack 64 and teeth 66 to produce a gear multiplier effect: that is, as the foot pedal 58 is moved from the first position wherein the motor drive shaft 42 and agitator brush 40 are both engaged by the belt 44 (see FIG. 2) to the second position wherein the belt 44 is disengaged from the motor drive shaft 42 (see FIG. 3), the foot pedal 58 and actuator 56 are rotated through an approximately 80° arc while the shifter 52 and lug 54 are rotated through an approximately 180° arc. Thus, the foot pedal 58 and actuator 56 are pivoted through a relatively short and conveniently and easily manipulated arc while the shifter 52 and lug 54 move through a much longer arc to provide the desired operation (note action arrows A and B in FIG. 4). This is possible since the tooth rack 64 is of a length substantially corresponding to the 180° circumference around the teeth 66 of the shifter 52.

As a result, the lug 54 is shifted from a first position between the agitator brush 40 and the motor drive shaft 42 within a pathway defined by the belt 44 to a second position wherein the lug is positioned to one side (the right side in FIG. 3) of both the agitator brush and the motor drive shaft. A detailed review of FIG. 3 shows that in this position, the lug 54 functions to completely disengage the belt 44 from the motor drive shaft 42. Accordingly, as the motor 30 continues to run, the fan 32 continues to be driven and generate vacuum suction. The agitator brush 40 is, however, no longer driven and, accordingly, stops. The net result is vacuum suction is slightly increased as the drag on the motor resulting from the driving of the agitator brush 40 ceases with the interruption of the drive mechanism by the lug 54. Further, the air flow that would otherwise be generated by the driven agitator brush 40 is eliminated. Thus, dirt, dust and debris are more effectively drawn into the nozzle 38 and through the hose 48 to the dust bag 36 when cleaning a bare floor surface.

It should further be appreciated that the actuator 56 also includes an integral catch 68. A spring 70 mounted to the nozzle assembly 14 includes a projecting distal end that rides along the edge 72 of the actuator 56 and engages in the cast 68 when the fort pedal 58 is manipulated into the second position shown in FIG. 3. Accordingly, the spring 70 functions to positively hold the carpet/bare floor mechanism 50 in the second position. The positive holding force mall however, be easily overcome by foot manipulation of the pedal 58 towards the first position shown in FIG. 2 when desired to reinstate operation of the agitator brush 40 for vacuuming a carpeted floor.

In summary, numerous benefits result from employing the concepts of the present invention. Specifically, the carpet/bare floor shifter mechanism 50 is of relatively simple design and is also advantageously, relatively simple and inexpensive to manufacture. It also provides very reliable operation over an extended service life. Advantageously, the carpet/bare floor shifter mechanism 50 provides the vacuum cleaner operator with a simple means for interrupting the drive between the motor 30 and the agitator brush 40 so as to allow more efficient and effective cleaning of bare floor surfaces. Specifically, the operator simply manipulates the foot pedal 58 in order to achieve the desired result.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

In the claims:

1. The vacuum cleaner, comprising:

a housing;

a an agitator brush mounted for relative rotation on said housing;

a motor held in said housing, said motor including a shaft for driving said agitator brush;

a flexible belt for connecting said motor shaft to said agitator brush; and a lug for operatively disconnecting said belt from one of said motor shaft and said agitator brush wherein said lug is carried on a shifter and an actuator is provided for selectively displacing said shifter between a first position wherein said lug is out of engagement with said belt and a second position wherein said lug engages said belt thereby forcing said belt out of engagement with one of said motor shaft and said agitator brush, said shifter and said actuator including meshing teeth.

2. The vacuum cleaner set forth in claim 1, wherein in said first position said lug is positioned between said agitator brush and said motor shaft within a pathway defined by said belt and in said second position said lug is positioned to one side of both said agitator brush and said motor shaft.

3. The vacuum cleaner set forth in claim 1, wherein said shifter rotates coaxially with said motor shaft and said actuator pivots about a point removed from said motor shaft.

4. The vacuum cleaner set forth in claim 1, wherein said actuator includes a foot pedal.

5. The vacuum cleaner, comprising:

a housing;

a an agitator brush mounted for relative rotation on said housing;

a motor held in said housing, said motor including both a fan for generating vacuum suction and a shaft for driving said agitator brush;

a flexible belt for connecting said motor shaft to said agitator brush;

an element selectively displaceable between a first position wherein said element is out of engagement with said belt and a second position wherein said element engages said belt forcing said belt out of engagement with one of said motor shaft and said agitator brush thereby allowing said agitator brush to come to a stop while said motor continues to drive said fan;

said element being carried on a shifter and an actuator being provided for selectively displacing said shifter between said first and second positions, said actuator including a tooth rack having a length L and said shifter including gear teeth having a circumference of approximately 2L.

6. The vacuum cleaner set forth in claim 5, wherein in said first position said element is positioned between said agitator brush and said motor shaft within a pathway defined by said belt and in said second position said element is positioned to one side of both said agitator brush and said motor shaft.

7. The vacuum cleaner set forth in claim 5, wherein said actuator includes an opening at least partially defined by said tooth rack, said opening receiving said gear teeth of said shifter with said tooth rack and gear teeth in meshing relationship.

8. The vacuum cleaner set forth in claim 7, wherein said shifter pivots coaxially about said motor shaft and said actuator includes a pivot pin spaced from said motor drive shaft.

9. The vacuum cleaner set forth in claim 8, wherein said actuator includes a foot pedal.

10. The vacuum cleaner set forth in claim 9, further including a spring for engaging said actuator and positively holding said shifter and said element in said second position.

* * * * *